US009093800B2

(12) United States Patent
Laub

(10) Patent No.: US 9,093,800 B2
(45) Date of Patent: Jul. 28, 2015

(54) LEADFRAME MODULE FOR AN ELECTRICAL CONNECTOR

(71) Applicant: Tyco Electronics Corporation, Berwyn, PA (US)

(72) Inventor: Michael Fredrick Laub, Enola, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 371 days.

(21) Appl. No.: 13/658,340

(22) Filed: Oct. 23, 2012

(65) Prior Publication Data

US 2014/0111960 A1 Apr. 24, 2014

(51) Int. Cl.

| | |
|---|---|
| ***H01R 13/648*** | (2006.01) |
| ***H01R 12/72*** | (2011.01) |
| ***H01R 13/03*** | (2006.01) |
| ***H01R 13/6585*** | (2011.01) |

(52) U.S. Cl.

CPC ..... *H01R 12/727* (2013.01); *H01R 13/035* (2013.01); *H01R 13/6585* (2013.01); *H01R 12/724* (2013.01)

(58) Field of Classification Search

CPC ..... H01R 23/688; H01R 23/7073; H01R 13/514; H01R 13/518; H01R 13/65807; H01R 13/658; H01R 24/50

USPC ..... 439/607.07, 607.08–607.11, 579, 79, 439/701

See application file for complete search history.

(56) References Cited

U.S. PATENT DOCUMENTS

| | | | | |
|---|---|---|---|---|
| 4,401,355 | A * | 8/1983 | Young | 439/607.11 |
| 4,451,107 | A * | 5/1984 | Dola et al. | 439/607.1 |
| 5,554,036 | A | 9/1996 | Shirai et al. | |
| 6,231,391 | B1 * | 5/2001 | Ramey et al. | 439/607.07 |
| 6,379,188 | B1 * | 4/2002 | Cohen et al. | 439/607.07 |
| 6,409,543 | B1 * | 6/2002 | Astbury et al. | 439/607.07 |
| 6,431,914 | B1 * | 8/2002 | Billman | 439/607.07 |
| 6,435,914 | B1 * | 8/2002 | Billman | 439/607.07 |
| 6,551,140 | B2 * | 4/2003 | Billman et al. | 439/607.07 |
| 6,692,305 | B2 * | 2/2004 | Nelson et al. | 439/607.07 |
| 7,191,966 | B2 * | 3/2007 | Sawczyszyn | 239/707 |
| 7,442,085 | B2 * | 10/2008 | Fuerst et al. | 439/620.09 |
| 7,517,250 | B2 * | 4/2009 | Hull et al. | 439/607.05 |

(Continued)

FOREIGN PATENT DOCUMENTS

| | | |
|---|---|---|
| WO | 01/13468 A2 | 2/2001 |
| WO | 01/57964 A1 | 8/2001 |

OTHER PUBLICATIONS

International Search Report, International Application No. PCT/US2013/066264, International Filing Date, Oct. 23, 2013.

*Primary Examiner* — Abdullah Riyami
*Assistant Examiner* — Vladimir Imas

(57) ABSTRACT

A leadframe module for an electrical connector includes a leadframe having contacts initially held together as part of the leadframe. The contacts have mating ends configured to be mated to corresponding mating contacts. The contacts having mounting ends configured to be terminated to corresponding conductors. Dielectric shells coat corresponding contacts. Outer shields are applied to corresponding dielectric shells. Each of the contacts, dielectric shells and outer shields define corresponding shielded transmission lines of the leadframe module. Optionally, a ground plate may be coupled to each of the transmission lines and electrically connected to the outer shields of the transmission lines to electrically common each of the outer shields.

20 Claims, 6 Drawing Sheets

(56) References Cited

U.S. PATENT DOCUMENTS

| | | | | |
|---|---|---|---|---|
| 7,553,190 | B2 * | 6/2009 | Laurx et al. | 439/607.07 |
| 7,594,826 | B2 * | 9/2009 | Kobayashi et al. | 439/607.07 |
| 7,618,289 | B2 * | 11/2009 | Rothermel et al. | 439/607.07 |
| 7,635,278 | B2 * | 12/2009 | Shuey et al. | 439/371 |
| 7,713,088 | B2 * | 5/2010 | Sercu et al. | 439/607.1 |
| 7,731,537 | B2 * | 6/2010 | Amleshi et al. | 439/607.05 |
| 7,736,182 | B2 * | 6/2010 | Pan | 439/607.07 |
| 7,753,731 | B2 * | 7/2010 | Cohen et al. | 439/607.09 |
| 7,758,357 | B2 * | 7/2010 | Pan et al. | 439/108 |
| 7,789,705 | B2 * | 9/2010 | Morgan | 439/607.07 |
| 7,862,344 | B2 * | 1/2011 | Morgan et al. | 439/67 |
| 7,867,031 | B2 * | 1/2011 | Amleshi et al. | 439/607.08 |
| 8,002,581 | B1 * | 8/2011 | Whiteman et al. | 439/607.18 |
| 8,147,254 | B2 * | 4/2012 | Shuey et al. | 439/74 |
| 8,157,591 | B2 * | 4/2012 | Fedder et al. | 439/607.07 |
| 8,187,034 | B2 * | 5/2012 | Fedder et al. | 439/607.01 |
| 8,192,232 | B2 * | 6/2012 | Whiteman et al. | 439/620.01 |
| 8,210,877 | B2 * | 7/2012 | Droesbeke | 439/607.11 |
| 8,342,888 | B2 * | 1/2013 | Amleshi et al. | 439/676 |
| 8,382,524 | B2 * | 2/2013 | Khilchenko et al. | 439/620.09 |
| 8,398,432 | B1 * | 3/2013 | McClellan et al. | 439/607.07 |
| 2009/0191727 | A1 | 7/2009 | Pan | |
| 2011/0212650 | A1 * | 9/2011 | Amleshi et al. | 439/660 |

* cited by examiner

LEADFRAME MODULE FOR AN ELECTRICAL CONNECTOR

BACKGROUND OF THE INVENTION

The subject matter herein relates generally to leadframe modules for electrical connectors.

Some electrical systems utilize electrical connectors to interconnect two circuit boards, such as a motherboard and daughtercard. The electrical connectors typically include chicklets or contact modules that are loaded into a housing for mating with a corresponding mating connector. The contact modules typically include overmolded leadframes manufactured from leadframes that are overmolded with dielectric material. As speed and performance demands increase, shielding is needed for the individual contacts of the contact modules. To redesign the contact modules for changes in the positions of the contacts or position of the shield, the overmolded dielectric body of the contact module needs to be redesigned. Such redesign typically requires expensive tooling and dies, making the overall manufacturing costs very high.

A need remains for an electrical system that can be manufactured in a cost effective and reliable manner.

BRIEF DESCRIPTION OF THE INVENTION

In one embodiment, a leadframe module for an electrical connector is provided including a leadframe having contacts initially held together as part of the leadframe. The contacts have mating ends configured to be mated to corresponding mating contacts. The contacts having mounting ends configured to be terminated to corresponding conductors. Dielectric shells coat corresponding contacts. Outer shields are applied to corresponding dielectric shells. Each of the contacts, dielectric shells and outer shields define corresponding shielded transmission lines of the leadframe module. Optionally, a ground plate may be coupled to each of the transmission lines and electrically connected to the outer shields of the transmission lines to electrically common each of the outer shields.

Optionally, the contacts may be stamped contacts. The dielectric shells may be powder coated dielectric shells. The outer shields may be printed outer shields applied directly to the dielectric shells. The outer shields of each transmission line may be separated by air gaps. The contacts may include transition portions extending between the mating ends and the mounting ends. The transition portions may be entirely peripherally surrounded by the corresponding dielectric shells. The dielectric shells are entirely peripherally surrounded by the corresponding outer shields.

Optionally, the transmission lines may be coaxial transmission lines with the dielectric shells electrically separating the contacts from the outer shields and with the outer shields providing electrical shielding for the corresponding contacts. The contacts may be right angled contacts with mating ends being generally perpendicular to the mounting ends, each contact being a different length than any adjacent contact thereto.

In another embodiment, an electrical connector is provided that includes a housing having a mating end and a loading end with slots open at the loading end. Leadframe modules are received in corresponding slots of the housing and supported by the housing. Each leadframe module includes a leadframe having contacts initially held together as part of the leadframe. The contacts have mating ends configured to be mated to corresponding mating contacts and mounting ends configured to be terminated to corresponding conductors. Dielectric shells coat corresponding contacts. Outer shields are applied to corresponding dielectric shells. Each of the contacts, dielectric shells and outer shields defining corresponding shielded transmission lines of the leadframe module. A ground plate is coupled to each of the transmission lines and is electrically connected to the outer shields of the transmission lines to electrically common each of the outer shields. The ground plates are received in a corresponding slot of the housing.

In another embodiment, a method of manufacturing a leadframe module is provided including stamping a leadframe to form a plurality of contacts having mating ends configured to be mated to corresponding mating contacts and mounting ends configured to be terminated to corresponding conductors. The method includes coating portions of the contacts between the mating and mounting ends with a dielectric material to form dielectric shells around the contacts. The method includes applying a conductive layer to the dielectric shells to form outer shields around the contacts and dielectric shells, the outer shields providing electrical shielding for the contacts.

DETAILED DESCRIPTION OF THE INVENTION

Figure 1:
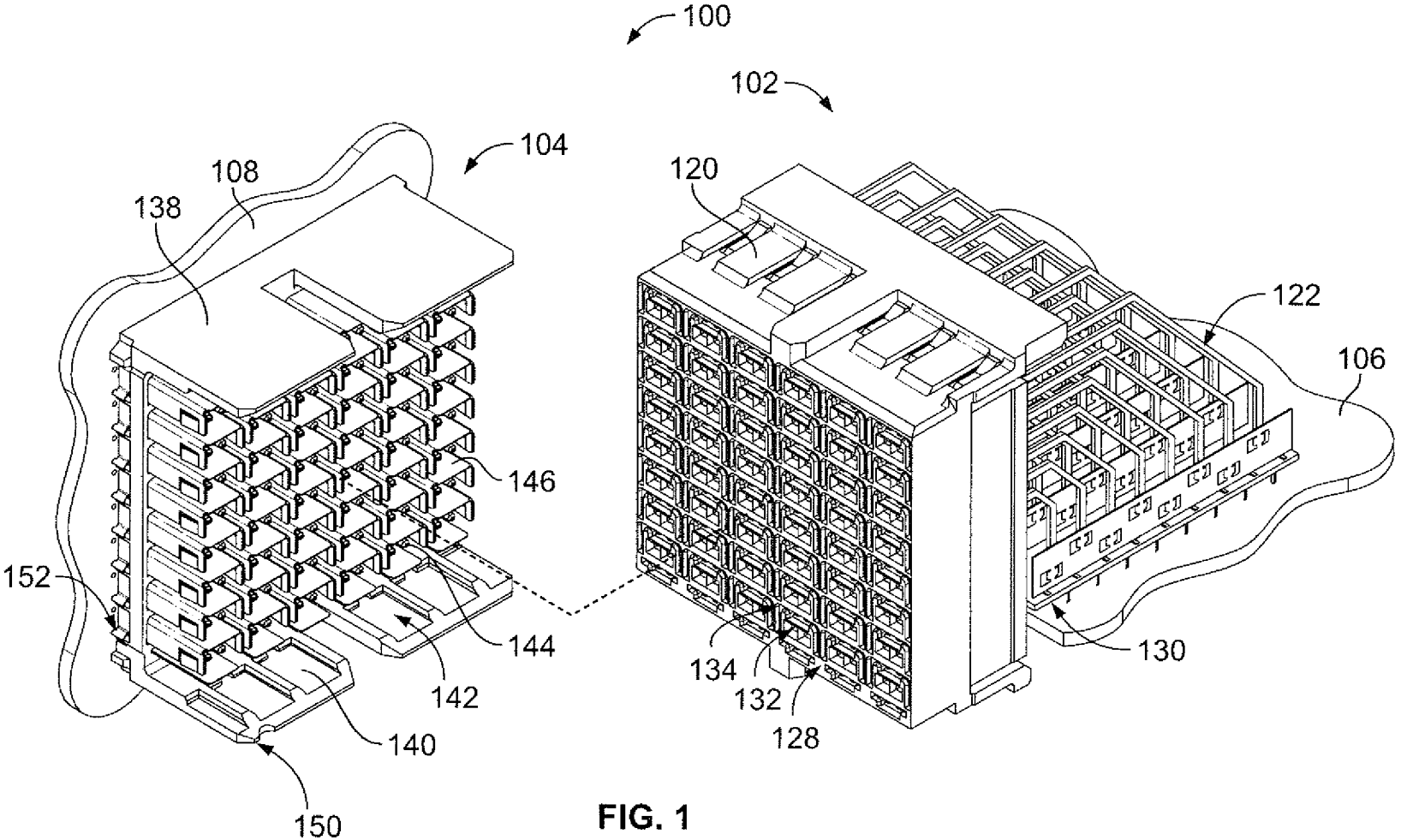
FIG. 1 is a perspective view of an exemplary embodiment of an electrical connector system illustrating a receptacle connector and a header connector that may be directly mated together.

FIG. 1 is a perspective view of an exemplary embodiment of an electrical connector system 100 illustrating a receptacle connector 102 and a header connector 104 that may be directly mated together. The electrical connector system 100 may be a high speed connector system passing high speed signals. For example, the electrical connector system 100 may include a plurality of transmission lines defined between circuit boards 106, 108. The system 100 may form part of a network or server system. Optionally, the electrical connector system 100 may form part of a backplane system with the header connector 104 defining a backplane side of the system 100 and the receptacle connector 102 defining a daughtercard side of the system 100. While the subject matter is described herein with reference to transmission lines for use in a high speed connector system, the subject matter is not limited to such application, and is but one example of an application that could use the transmission line structure described herein.

The receptacle connector 102 includes a housing 120 that holds a plurality of leadframe modules 122. Any number of leadframe modules 122 may be provided to increase the density of the receptacle connector 102. The leadframe modules 122 each include a plurality of contacts 124 (shown in FIG. 2) that are received in the housing 120 for mating with the header connector 104. In an exemplary embodiment, each contact 124 forms part of a shielded transmission line configured to convey data signals.

The receptacle connector 102 includes a mating end 128 and a mounting end 130. The contacts 124 are received in the housing 120 and held therein at the mating end 128 for mating to the header connector 104. The contacts 124 are arranged in a matrix of rows and columns. Any number of contacts 124 may be provided in the rows and columns. The contacts 124 also extend to the mounting end 130 for mounting to the circuit board 106. Optionally, the mounting end 130 may be substantially perpendicular to the mating end 128, defining a right angle receptacle connector. Alternatively, the mating end 128 and mounting end 130 may be parallel to each other, defining a mezzanine connector.

The housing 120 includes a plurality of signal contact openings 132 and a plurality of ground contact openings 134 at the mating end 128. The contacts 124 are received in corresponding signal contact openings 132. Optionally, a single contact 124 is received in each signal contact opening 132. The signal contact openings 132 may also receive corresponding header signal contacts 144 therein when the receptacle and header connectors 102, 104 are mated. The ground contact openings 134 receive header shields 146 therein when the receptacle and header connectors 102, 104 are mated. The ground contact openings 134 receive grounding beams 228 (shown in FIG. 2) of the leadframe modules 122 that mate with the header shields 146 to electrically common the receptacle and header connectors 102, 104.

The housing 120 is manufactured from a dielectric material, such as a plastic material. The housing 120 provides support for the leadframe modules 122. The housing 120 holds the leadframe modules 122 along parallel planes. Optionally, the leadframe modules 122 may be loaded into the rear of the housing 120 and extend rearward therefrom with portions of the leadframe modules 122 exposed. Alternatively, the housing 120 may cover the entire leadframe modules 122, such as to protect the leadframe modules 122 from damage. In other alternative embodiments, the leadframe modules 122 may be loaded into the housing 120 through a top or a bottom of the housing 120 rather than through the rear of the housing 120. The housing 120 may include channels separated by walls that support and position the leadframe modules 122 within the housing 120.

The header connector 104 includes a header housing 138 having walls 140 defining a chamber 142. The header connector 104 has a mating end 150 and a mounting end 152 that is mounted to the circuit board 108. Optionally, the mounting end 152 may be substantially parallel to the mating end 150. The receptacle connector 102 is received in the chamber 142 through the mating end 150. The housing 120 engages the walls 140 to hold the receptacle connector 102 in the chamber 142. The header signal contacts 144 and the header shields 146 extend from a base wall 148 into the chamber 142. The header signal contacts 144 and the header shields 146 extend through the base wall 148 and are mounted to the circuit board 108.

In an exemplary embodiment, the header signal contacts 144 are arranged as differential pairs. The header shields 146 are positioned between the differential pairs to provide electrical shielding between adjacent differential pairs. In the illustrated embodiment, the header shields 146 are C-shaped and provide shielding on three sides of the pair of header signal contacts 144. In alternative embodiments, rather than arranging the header signal contacts 144 as differential pairs, the header signal contacts may be arranged as single contacts with shielding at appropriate locations. The header shields 146 may have other shapes in alternative embodiments.

Figure 2:
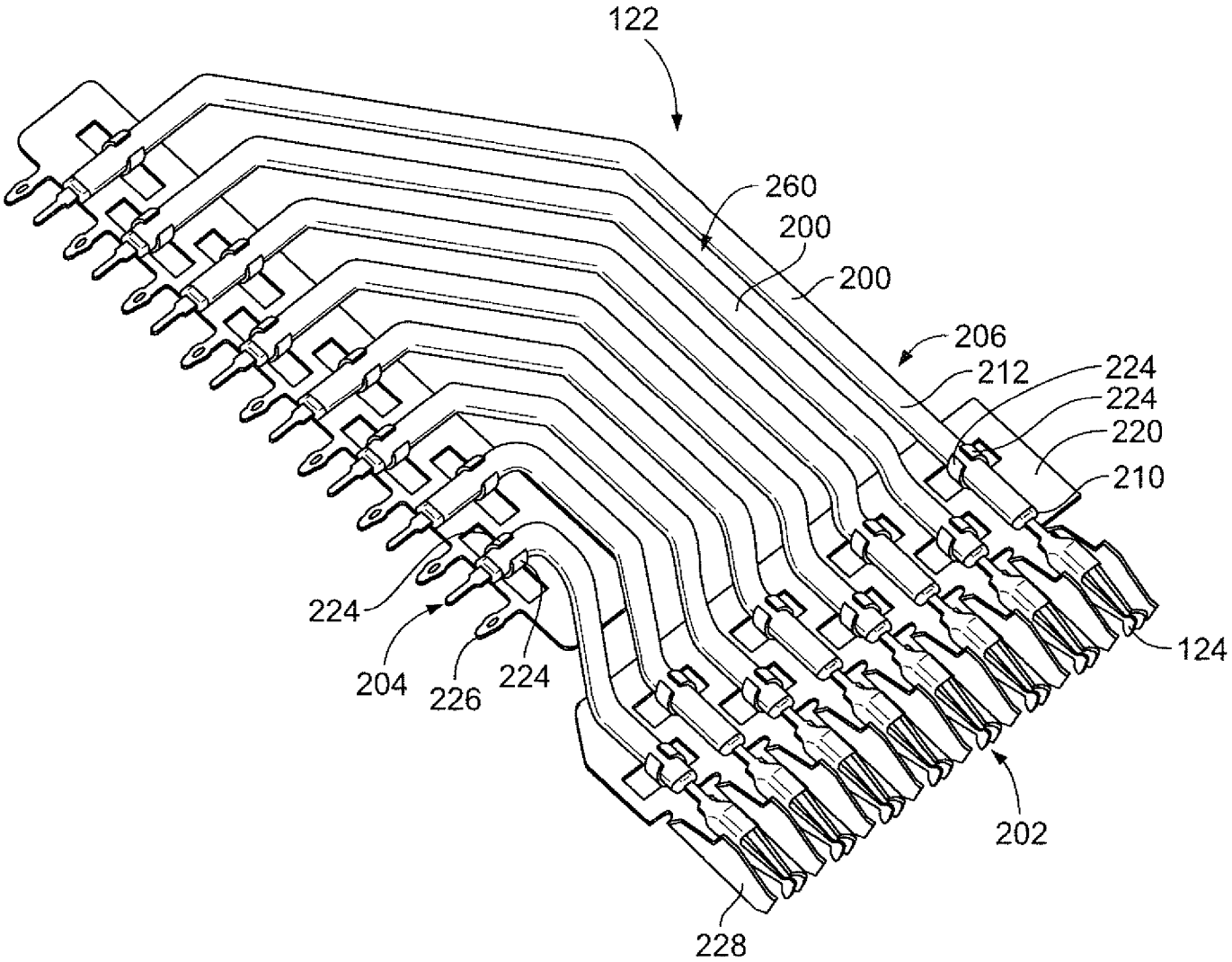
FIG. 2 is a side perspective view of a leadframe module for the receptacle connector and formed in accordance with an exemplary embodiment.
Figure 3:
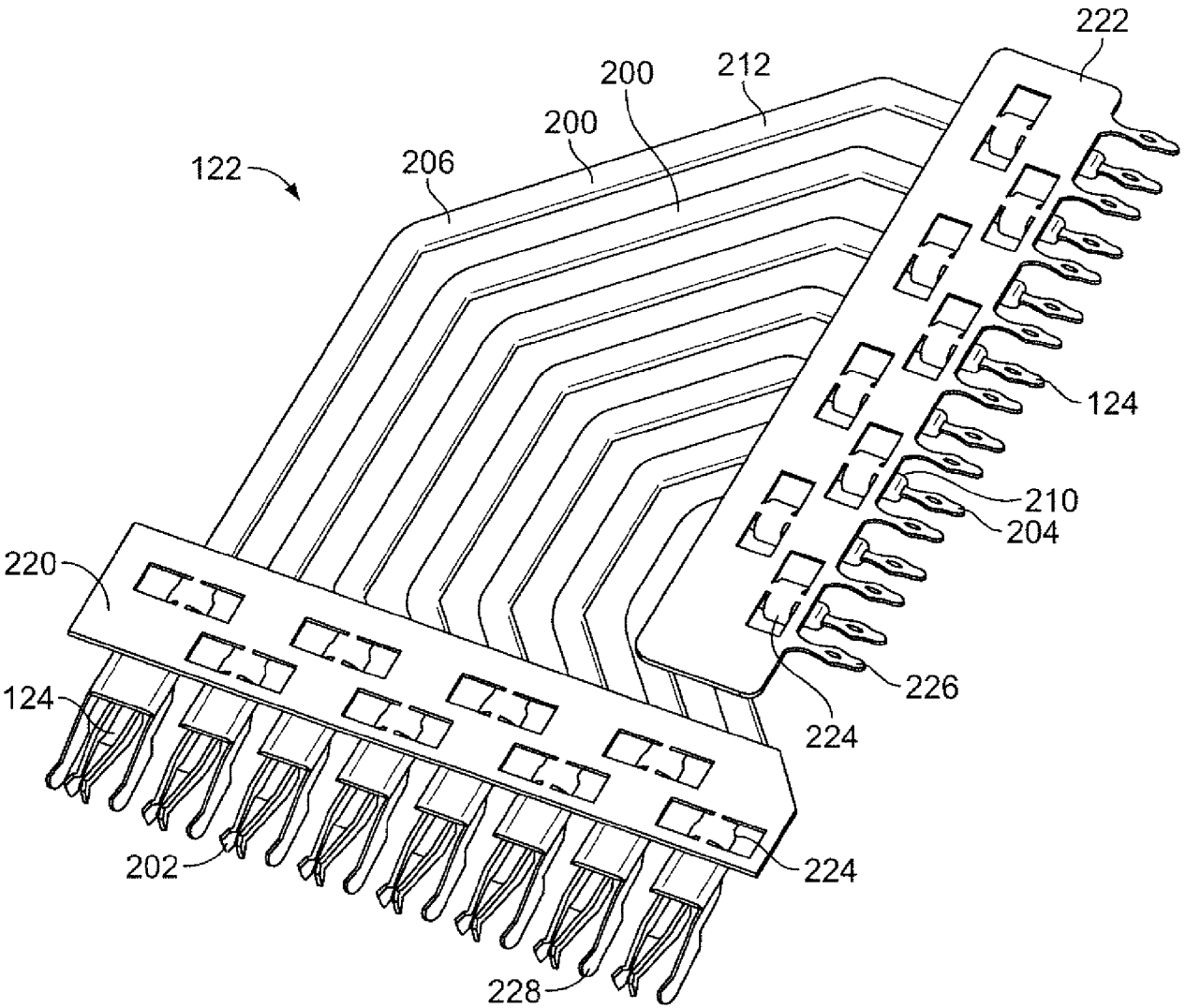
FIG. 3 is another side view of the leadframe module.

FIG. 2 is a side perspective view of the leadframe module 122 formed in accordance with an exemplary embodiment. FIG. 3 is another side view of the leadframe module 122. The leadframe module 122 includes a plurality of transmission lines 200 configured to convey data signals. The transmission lines 200 may convey high speed data signals. The transmission lines 200 are separated by air gaps 260 and do not include overmolded dielectric bodies holding all of the contacts 124 together as part of a common module, as is common of conventional contact modules. In an exemplary embodiment, the transmission lines 200 are individually electrically shielded.

Each transmission line 200 includes a corresponding contact 124. The contact 124 extends between a mating end 202 and a mounting end 204. The mating ends 202 of the contacts 124 are configured to be mated to corresponding mating contacts, such as the header signal contacts 144 (shown in FIG. 1). In the illustrated embodiment, the mating ends 202 each include a pair of opposed spring beams configured to receive the header signal contact 144 there between. Other types of mating interfaces may be provided that the mating ends 202 in alternative embodiments.

The mounting ends 204 of the contacts 124 are configured to be terminated to corresponding conductors. For example, the mounting ends 204 may be terminated to traces, plated vias, or pads on the circuit board 106 (shown in FIG. 1) defining electrical conductors of the circuit board 106. The mounting ends 204 may be terminated to other types of conductors in alternative embodiments. For example, the mounting ends 204 may be terminated to corresponding wires or cables rather than the circuit board 106. In the illustrated embodiment, the mounting ends 204 of the contacts 124 are solder pins configured to be inserted into plated vias of the circuit board 106 and soldered therein to make an electrical connection to the circuit board 106. Alternatively, the mounting ends 204 of the contacts 124 may be compliant pins or other types of contacts.

The contacts 124 include transition portions 206 extending between the mating and mounting ends 202, 204. In the illustrated embodiment, the contacts 124 are right angle contacts with the mating ends 202 being generally perpendicular to the mounting ends 204. Each of the contacts 124 have a different length than any adjacent contact 124. The transition portions 206 each have different length.

The transmission lines 200 include dielectric shells 210 coating corresponding contacts 124. The transmission lines 200 include outer shields 212 applied to corresponding dielectric shells 210. The outer shields 212 provide electrical shielding for corresponding contacts 124. The dielectric shells 210 electrically separate the contacts 124 from the corresponding outer shields 212. The outer shields 212 individually shield each of the contacts 124 along a majority of the length of the contacts 124. The outer shields 212 extend generally along the entire length of the transmission portions 206 of the contacts 124. The transmission portions 206 are entirely peripherally surrounded by corresponding dielectric shells 210. The dielectric shells 210 are entirely peripherally surrounded by corresponding outer shields 212. The spacing between the outer shields 212 and the contacts 124 may be controlled to control an impedance of the transmission lines 200. For example, the thickness of the dielectric shells 210 may be controlled to define a separation distance between the outer shields 212 and the contacts 124. Tight control of the positioning of the outer shields 212 with respect to the contacts 124 may achieve a target impedance for the transmission lines 200 to increase performance of the receptacle connector 102. The transmission lines 200 are separated by the air gaps 260.

In an exemplary embodiment, the leadframe module 122 includes ground plates 220, 222 coupled to each of the transmission lines 200. The ground plates 220, 222 are configured to be electrically connected to the outer shields 212 of the transmission lines 200 to electrically common each of the outer shields 212. The ground plates 220, 222 provide mechanical support for the transmission lines 200. In an exemplary embodiment, the front ground plate 220 is positioned proximate to the mating ends 202 of the contacts 124 and the bottom ground plate 222 is positioned proximate to the mounting ends 204 of the contacts 124. Any number of ground plates may be used. The ground plates 220, 222 may be connected together to control the relative positions of the ground plates 220, 222. Optionally, the ground plates may extend along the entire transition portions 206 rather than be located just at the mating ends 202 and mounting end 204. In an exemplary embodiment, the ground plates 220, 222 are generally planar and extend along one side of the transmission lines 200. The ground plates 220, 222 include fingers 224 that engage and hold the transmission lines 200. Optionally, the fingers 224 may be crimped around the transmission lines 200. The fingers 224 may be stamped from the ground plates 220, 222 and wrapped around the transmission lines 200. The fingers 224 directly engage the outer shields 212 to electrically connect the ground plates 220, 222 to the transmission lines 200.

In an exemplary embodiment, the bottom ground plate 222 includes pins 226 extending therefrom. The pins 226 are configured to be electrically connected to a ground plane of the circuit board 106 (shown in FIG. 1). In the illustrated embodiment, the pins 226 are compliant pins, such as eye of the needle contacts, that are configured to be loaded into vias of the circuit board 106. The ground plate 220 is directly grounded to the circuit board 106. The ground plate 220 provides a grounded electrical path between the outer shields 212 and the circuit board 106.

In an exemplary embodiment, the front ground plate 220 includes a plurality of ground beams 228 extended forward therefrom. The ground beams 228 are positioned between adjacent contacts 124. The ground beams 228 extend along the mating ends 202 of the contacts 124. The ground beams 228 are configured to be electrically connected to corresponding header shields 146 (shown in FIG. 1) when the receptacle connector 102 is mated to the header connector 104 (both shown in FIG. 1). The ground beams 228 may be deflectable such that the ground beams 228 may be biased against the header shields 146 when mated thereto. The ground beams 228 create a grounded electrical path between the leadframe module 122 and the header connector 104. The grounding beams 228 provide electrical shielding between the mating ends 202 of the contacts 124. In an exemplary embodiment, the ground beam 228 are stamped from the ground plate 222 and bent approximately perpendicularly with respect to the ground plate 222 to position the ground beams 228 in plane with the mating ends 202 of the contacts 124.

Comparing the leadframe module 122 with conventional chicklets or contact modules of known receptacle connectors, the leadframe module 122 may be manufactured inexpensively and without the need for large tooling costs to design and develop the leadframe module 122. For example, conventional chicklets include over molded leadframes that include complicated shielding structures to provide electrical shielding between adjacent leads of the leadframe. The leadframe module 122 is manufactured simply by coating the dielectric shells 210 over the contacts 124 and then applying the outer shields 212 to the dielectric shells 210. The coating and shield application may be easily applied to the contacts 124 irrespective of the size, shape, spacing or other physical parameters of the contacts 124, whereas expensive tools and dies are needed to redesign the over mold of the leadframe of conventional chicklets when any modifications to the chicklet design are needed.

Figure 4:
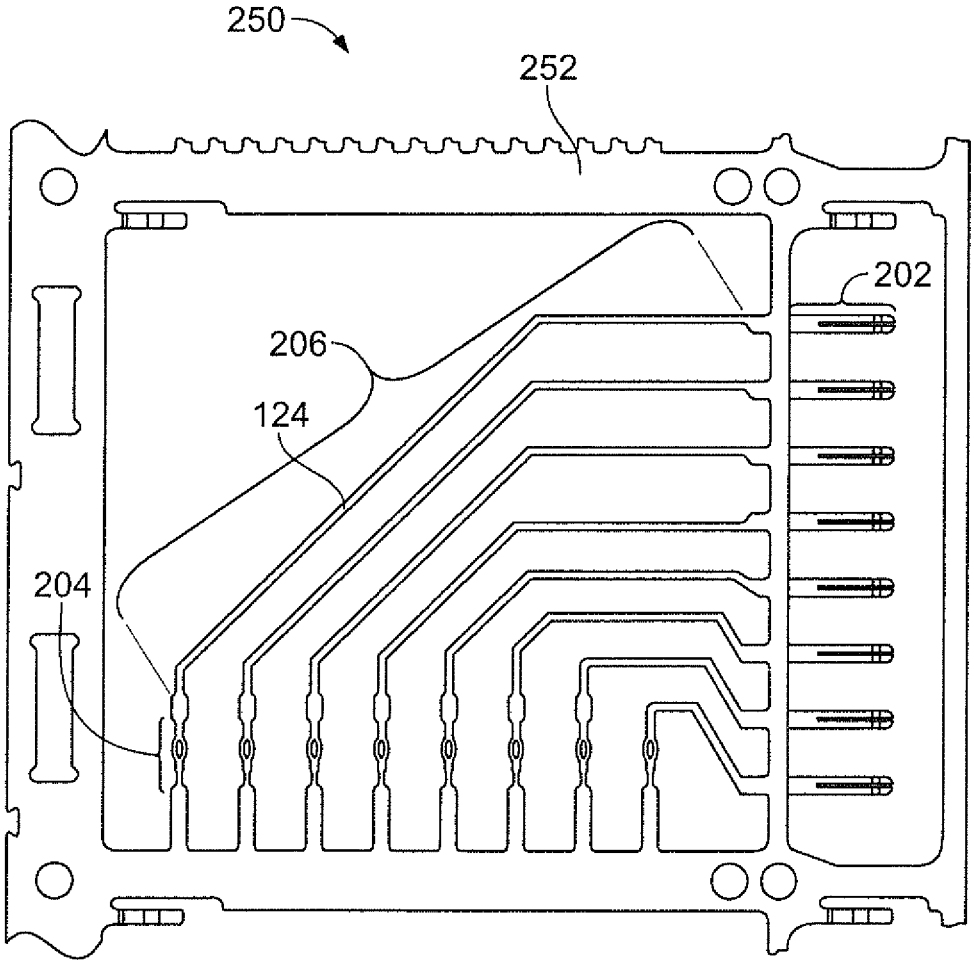
FIG. 4 illustrates a leadframe of the leadframe module formed in accordance with an exemplary embodiment.

FIG. 4 illustrates a leadframe 250 formed in accordance with an exemplary embodiment. The leadframe 250 may be stamped and formed from a stock metal sheet. After being stamped, the leadframe 250 includes a carrier 252 holding a plurality of the contacts 124. The carrier 252 is later removed when the contacts 124 are singulated from one another. The transition portions 206, mating ends 202 and mounting ends 204 are all stamped and formed from the stock piece of metal and initially held together by the carrier 252. The leadframe 250 may be processed to form the transmission lines 200 (shown in FIGS. 2 and 3). For example, the leadframe 250 may be coated with a dielectric material to form the dielectric shells 210 (shown in FIGS. 2 and 3). The dielectric shells 210 may be covered by conductive layers to form the outer shields 212 (shown in FIGS. 2 and 3).

Figure 5:
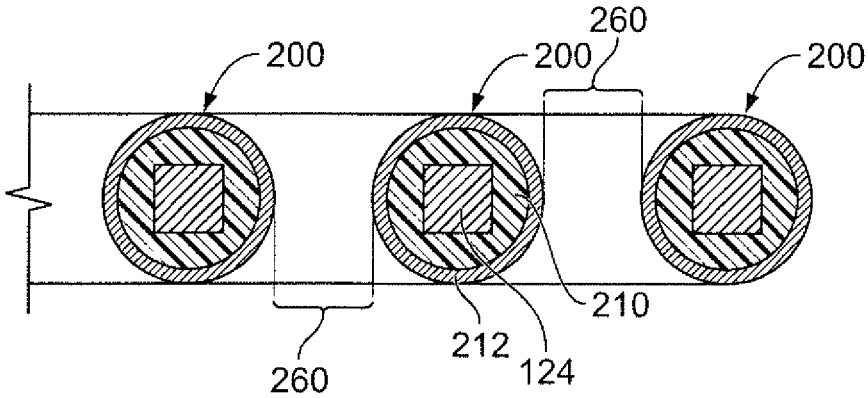
FIG. 5 is a cross sectional view of a transmission line of the leadframe module formed in accordance with an exemplary embodiment.

FIG. 5 is a cross sectional view of the transmission line 200 formed in accordance with an exemplary embodiment. The transmission line 200 includes the contact 124, the dielectric shell 210 surrounding the contact 124 and the outer shield 212 surrounding the dielectric shell 210. In an exemplary embodiment, the air gaps 260 are defined between adjacent transmission lines 200.

Figure 6:
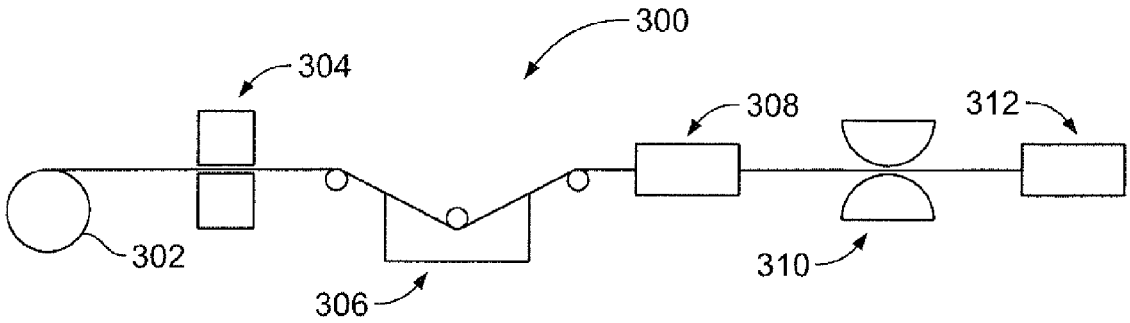
FIG. 6 illustrates a machine used to manufacture leadframe modules and receptacle connectors.

FIG. 6 illustrates a machine used to manufacture leadframe modules 122 and receptacle connectors 102. In an exemplary embodiment, the leadframe modules 122 are continuously manufactured using a reel system to pull the product through the machine 300. The product is initially wound on a reel 302 and is feed through the machine 300 from the reel 302. The product may be a metal strip that is fed from the reel 302.

The machine 300 includes a stamp 304 or press that is used to stamp the leadframe 250 (shown in FIG. 4) from the metal sheet. During the stamping, portions of the sheet may be removed and recycled leaving the contacts 124 (shown in FIG. 4) on the carrier 252 (shown in FIG. 4). The contacts 124 may be formed or bent during the stamping process.

The machine 300 includes a coating station 306. In an exemplary embodiment, the coating station 306 may be a powder coating station. The coating station 306 applies the dielectric shell 210 to the contacts 124. The dielectric shell 210 may be spray coated or may be coated using a fluidized bed. At the coating station 306, the leadframe 250 is electrically grounded and electrically charged powder is applied to the leadframe 250. Optionally, portions of the leadframe 250 may be masked or otherwise covered to resist coating in such areas. Such selective coating applies the dielectric shells 210 to the transition portions 206 as oppose to the mating ends 202 and mounting ends 204. The conductive metal of the contacts 124 remains exposed at the mating end 202 and mounting end 204.

The thickness of the dielectric shells 210 may be controlled by controlling an amount of time that the product is at the coating station 306, by changing the voltage applied to the leadframe 250, by changing the material of the dielectric shells 210 and the like. Optionally, the dielectric shells 210 may have uniform thicknesses radially surrounding the entire contacts 124.

The machine 300 may include other types of stations other than the coating station 306 to apply the dielectric material to the leadframe 250. For example, the dielectric material may be printed on the contacts 124 by a printing station, the dielectric material may be applied by a chemical vapor deposition process, by a physical vapor deposition process, by a dipping process, by a spraying process or by other processes known in the art to apply dielectric material to a substrate.

The machine 300 includes a post processing station 308 downstream of coating station 306. The post processing station 308 is used to process the leadframe 250 and the dielectric shell 210 to prepare the dielectric shells 210 for applying the outer shields 212 thereto. For example, the dielectric shells 210 may be thermally cured in a reflow oven to cure the dielectric material. The dielectric shells 210 may be cleaned and or may be selectively removed from the contact 124 at the post processing station 308. Other post processing functions may be performed at the post processing station 308.

The machine 300 includes an application station 310. The outer shields 212 are applied to the dielectric shells 210 at the application station 310. In an exemplary embodiment, the application station 310 may be a printing station, wherein conductive ink is printed directly on the dielectric shells 210. The conductive ink may be printed using a pad printer, an ink jet printer or another type of printer. In alternative embodiments, the conducive layer defining the outer shields 212 may be applied by other processes such as a spraying process, a plating process, or another type of process known in the art to apply a conductive layer to a substrate. The conductive layer may be processed to enhance characteristics of the conductive layer, such as to enhance the conductivity of the conductive layer. For example, a conductive ink may initially be applied to the dielectric shells to form a base conductive layer, and the base conductive layer may then be further processed, such as by electro-plating or electro-less plating. The application station 310 applies the conductive layers to the dielectric shells 210 such that the conductive layers entirely peripherally surround the dielectric shells 210. As such, the contacts 124 have 360° shielding providing by the outer shields 212.

The machine 300 includes a second post processing station 312 after the application station 310. At the post processing station 312, the leadframe 250 may be processed, such as to cure the outer shields 212. At the post processing station 312, the carrier 252 may be removed, such as by stamping or cutting the carrier 252 from the contacts 124. At the post processing station 312, the ground plates 220 may be coupled to the transmission lines 200. At the post processing station 312, the leadframe module 122 may be inserted into the housing 120 to form the receptacle connector 102.

Figure 7:
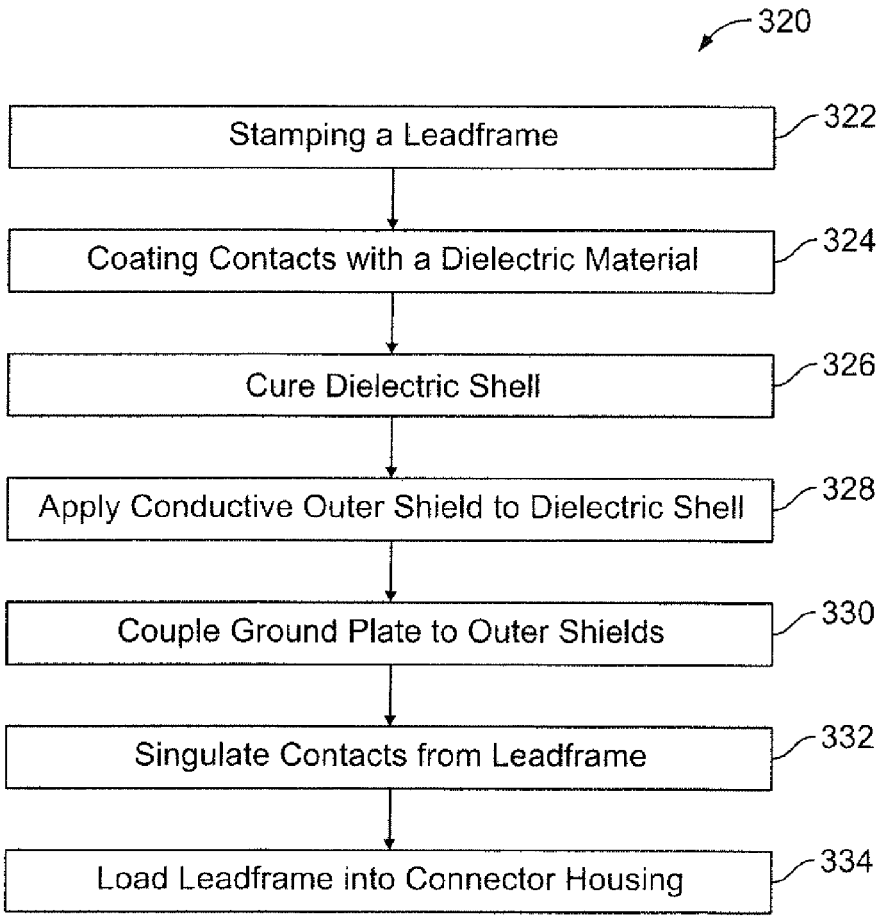
FIG. 7 illustrates a method of manufacturing a leadframe module and a receptacle connector.

FIG. 7 illustrates a method 320 of manufacturing a leadframe module 122 and a receptacle connector 102. At 322, the method includes stamping a leadframe from a metal sheet. When the leadframe 250 is stamped, the contacts 124 thereof are initially held together by a carrier 252, which is later removed.

At 324, the method includes coating the contacts 124 with the dielectric material to form the dielectric shells 210. The contacts 124 may be selectively plated along certain portions of the contacts 124. For example, the transition portions 206 may be coated with the dielectric material. Optionally, the coating may be applied by powder coating the contacts 124. The dielectric material may be sprayed onto the contacts 124. Alternatively, the dielectric material may be dip coated by submersing the leadframe 250 in a bath or bed of electrically charged, powdered dielectric material. Other types of coating processes may be used in alternative embodiments. The dielectric shells 210 may be applied to the contacts 124 by other processes other than coating in alternative embodiments.

At 326, the dielectric shells are cured. For example, the leadframe 250 may be passed through a reflow oven to thermally cure the dielectric material to form the dielectric shells 210.

At 328, the method includes applying conductive outer shields 212 to the dielectric shells 210. The outer shields 212 may be applied by printing conductive layer onto the dielectric shells 210. The conductive layer may be applied by printing conductive ink on the dielectric shell 210. For example, a silver ink maybe printed on the dielectric shell 210. The conductive ink may be pad printed, ink jet printed, or printed by other processes. The outer shields 212 may be applied to the dielectric shells 210 by other processes in alternative embodiments.

At 330, the method includes coupling the ground plates 222, 220 to the outer shields 212. The ground plates 220, 222 may be coupled to the outer shields 212 by crimping the fingers 224 to the outer shields 212. Other securing means or processes may be used in alternative embodiments, such as soldering the ground plates 220, 222 to the outer shields 212.

At 332, the method includes singulating the contacts 124 from the carrier 252 of the leadframe 250. The contacts 124 may be singulated from the carrier 252 by punching, cutting, or otherwise removing the carrier 252 from the leadframe 250. Once the contacts 124 are singulated, the contacts 124 are electrically isolated from each other such that the contacts 124 may convey different signals. In an exemplary embodiment, the carrier 252 is removed after the ground plates 220, 222 are coupled to the outer shields 212. The ground plates 220, 222 provide structural support for the transmission lines 200 and allow removal of the carrier 252.

At 334, the method includes loading the leadframe modules 122 into the housing 120 of the receptacle connector 102. A plurality of the leadframe modules 122 may be loaded into the housing 120 to form the receptacle connector 102.

Figure 8:
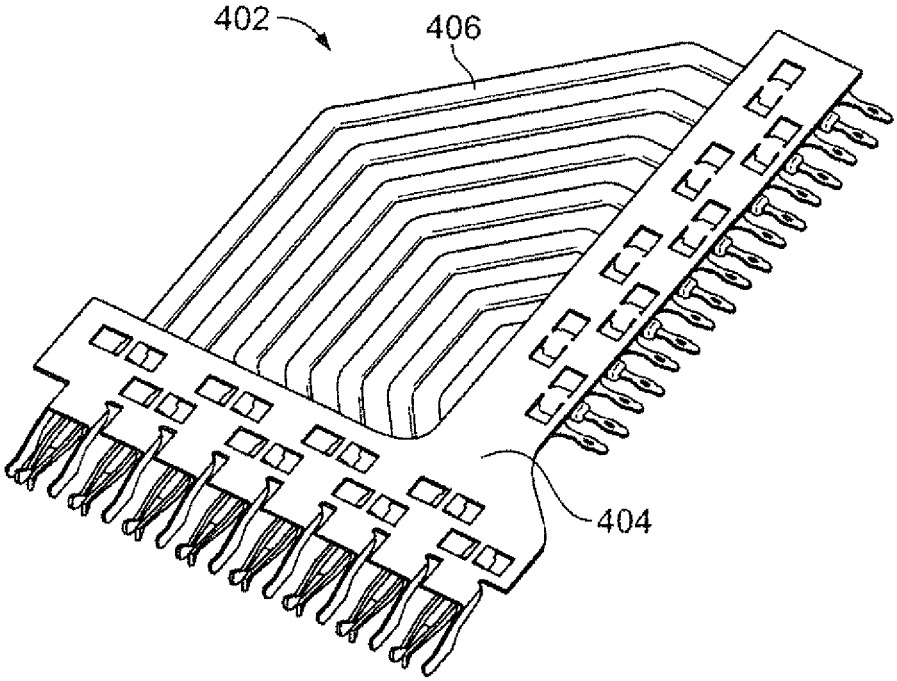
FIG. 8 illustrates a leadframe module formed in accordance with an exemplary embodiment.

FIG. 8 illustrates a leadframe module 402 formed in accordance with an exemplary embodiment. The leadframe module 402 is similar to the leadframe module 122 (shown in FIGS. 2 and 3) however the leadframe module 402 includes a single ground plate 404. The ground plate 404 is L-shaped and extends along mating and mounting ends of transmission lines 406 of the leadframe module 402. The transmission lines 406 may be more rigidly held together by having a single ground plate 404 rather than the front and bottom ground plates 220, 222 (shown in FIGS. 2 and 3).

Figure 9:
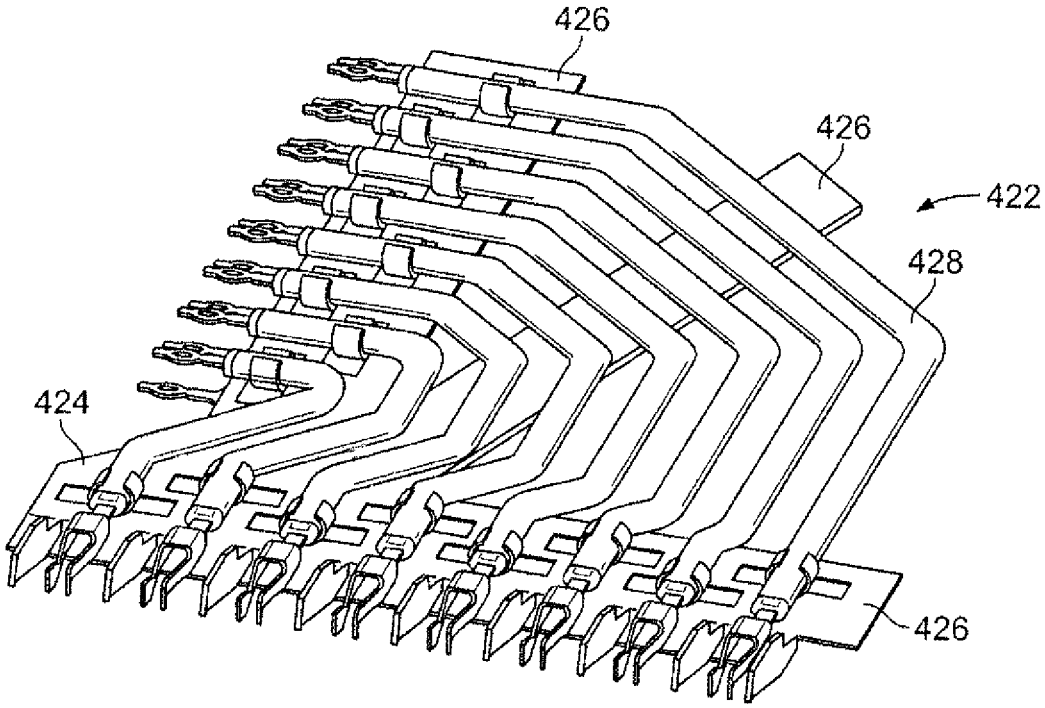
FIG. 9 illustrates a leadframe module formed in accordance with an exemplary embodiment.

FIG. 9 illustrates a leadframe module 422 formed in accordance with an exemplary embodiment. The leadframe module 422 is similar to the leadframe modules 122 (shown in FIGS. 2 and 3) and 402 (shown in FIG. 8), however the leadframe module 422 includes a single ground plate 424 having a plurality of spokes 426. The ground plate 424 extends along mating and mounting ends of transmission lines 428 of the leadframe module 422 as well as along central portions of the transmission lines 428 to provide additional support for the transmission lines 428.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A leadframe module for an electrical connector comprising:

a leadframe having contacts initially held together as part of the leadframe, the contacts having mating ends configured to be mated to corresponding mating contacts, the contacts having mounting ends configured to be terminated to corresponding conductors;

dielectric shells coating corresponding contacts; and conductive outer shields applied to corresponding dielectric shells to provide electrical shielding for the corresponding contacts;

each of the contacts, dielectric shells and outer shields defining corresponding shielded transmission lines of the leadframe module.

2. The leadframe module of claim 1, wherein the contacts are stamped contacts.

3. The leadframe module of claim 1, wherein the outer shields of each transmission line are separated by air gaps.

4. The leadframe module of claim 1, wherein the contacts include transition portions extending between the mating ends and the mounting ends, the transition portions being entirely peripherally surrounded by the corresponding dielectric shells, the dielectric shells being entirely peripherally surrounding by the corresponding outer shields.

5. The leadframe module of claim 1, wherein the dielectric shells are powder coated dielectric shells.

6. The leadframe module of claim 1, wherein the outer shields are printed outer shields applied directly to the dielectric shells.

7. The leadframe module of claim 1, wherein the transmission lines are coaxial transmission lines with the dielectric shells electrically separating the contacts from the outer shields and with the outer shields providing electrical shielding for the corresponding contacts.

8. The leadframe module of claim 1, wherein the contacts are right angled contacts with mating ends being generally perpendicular to the mounting ends, each contact being a different length than any adjacent contact thereto.

9. The leadframe module of claim 1, further comprising a ground plate coupled to each of the transmission lines, the ground plate being electrically connected to the outer shields of the transmission lines to electrically common each of the outer shields.

10. The leadframe module of claim 1, wherein the dielectric shells include a plating layer.

11. An electrical connector comprising:

a housing having a mating end and a loading end, the housing having slots open at the loading end; and leadframe modules received in corresponding slots of the housing, the leadframe modules being supported by the housing, each leadframe module comprising:

a leadframe having contacts initially held together as part of the leadframe, the contacts having mating ends configured to be mated to corresponding mating contacts, the contacts having mounting ends configured to be terminated to corresponding conductors;

dielectric shells coating corresponding contacts;

outer shields applied to corresponding dielectric shells, wherein each of the contacts, dielectric shells and outer shields defining corresponding shielded transmission lines of the leadframe module; and a ground plate coupled to each of the transmission lines, the ground plate being electrically connected to the outer shields of the transmission lines to electrically common each of the outer shields, the ground plate being received in a corresponding slot of the housing.

12. The electrical connector of claim 11, wherein the contacts are stamped contacts.

13. The electrical connector of claim 11, wherein the outer shields of each transmission line are separate by air gaps.

14. The electrical connector of claim 11, wherein the contacts include transition portions extending between the mating ends and the mounting ends, the transition portions being entirely peripherally surrounded by the corresponding dielectric shells, the dielectric shells being entirely peripherally surrounding by the corresponding outer shields.

15. The electrical connector of claim 11, wherein the outer shields are printed outer shields applied directly to the dielectric shells.

16. The electrical connector of claim 11, wherein the transmission lines are coaxial transmission lines with the dielectric shells electrically separating the contacts from the outer shields and with the outer shields providing electrical shielding for the corresponding contacts.

17. A method of manufacturing a leadframe module, the method comprising:

stamping a leadframe to form a plurality of contacts having mating ends configured to be mated to corresponding mating contacts and mounting ends configured to be terminated to corresponding conductors;

coating portions of the contacts between the mating and mounting ends with a dielectric material to form dielectric shells around the contacts;

applying a conductive layer to the dielectric shells to form outer shields around the contacts and dielectric shells, the outer shields providing electrical shielding for the contacts.

18. The method of claim 17, wherein said coating includes powder coating the contacts to form the dielectric shells.

19. The method of claim 17, wherein said applying a conductive layer comprises printing a conductive ink on the dielectric shells.

20. The method of claim 17, further comprising coupling a ground plate to the outer shields to electrically common each of the outer shields.

* * * * *